US007475796B2

(12) United States Patent
Garton

(10) Patent No.: US 7,475,796 B2
(45) Date of Patent: Jan. 13, 2009

(54) INDUSTRIAL HOPPER WITH SUPPORT

(75) Inventor: Darwin Garton, Lincoln, NE (US)

(73) Assignee: Snyder Industries, Inc., Lincoln, NE (US)

( * ) Notice: Subject to any disclaimer, the term of this patent is extended or adjusted under 35 U.S.C. 154(b) by 591 days.

(21) Appl. No.: 11/130,914

(22) Filed: May 17, 2005

(65) Prior Publication Data

US 2006/0277783 A1 Dec. 14, 2006

(51) Int. Cl.
*B67D 5/64* (2006.01)

(52) U.S. Cl. ..... 222/185.1; 220/647; 220/1.5; 220/668; 211/153; 211/183

(58) Field of Classification Search ..... 222/185.1, 222/105, 630, 637, 195, 185.2, 608, 143, 222/180, 181.1–181.3, 460, 462; 414/415; 248/146, 150; 108/55.1, 55.5; 141/114; 206/512, 583; 211/153, 183; 220/1.5, 4.17, 220/23.91, 628, 630, 636, 647, 668, 737, 220/920

See application file for complete search history.

(56) References Cited

U.S. PATENT DOCUMENTS 1,342,807 A * 6/1920 Harrington ..... 220/4.12
1,351,251 A * 8/1920 Jewell ..... 222/288
1,655,533 A * 1/1928 Capagna ..... 141/378
2,765,137 A * 10/1956 Tatko ..... 108/55.1
3,174,728 A * 3/1965 Mack ..... 366/213
3,281,104 A * 10/1966 Hamilton ..... 248/188
3,294,306 A * 12/1966 Areddy ..... 206/596
3,318,473 A * 5/1967 Jones et al. ..... 414/608
3,387,749 A * 6/1968 Godshalk et al. ..... 222/143
3,517,828 A * 6/1970 Hunter ..... 211/194
3,590,888 A * 7/1971 Coleman ..... 141/5
3,639,007 A * 2/1972 Dare et al. ..... 406/91
3,706,392 A * 12/1972 Sprick et al. ..... 220/812
4,031,663 A * 6/1977 Brunk ..... 47/66.1
4,344,645 A * 8/1982 Kirk ..... 285/61
4,366,905 A * 1/1983 Forshee ..... 206/511
4,398,653 A * 8/1983 Daloisio ..... 222/143
4,516,686 A * 5/1985 Chaussepied ..... 220/745

(Continued)

OTHER PUBLICATIONS

Siouxland Press vol. 34 No. 24 article "Den Hartog Industries Holds Annual Product Display", Jun. 11, 2003, (1 page).

(Continued)

*Primary Examiner*—Kevin P Shaver
*Assistant Examiner*—Andrew P Bainbridge
(74) *Attorney, Agent, or Firm*—Hovey Williams LLP

(57) ABSTRACT

An industrial hopper and support system includes a hopper having a plurality of receivers complementally configured to receive the top ends of legs of a support. The hopper is particularly designed to receive and discharge both solid and liquid material by the mounting of a selected valve, and the receivers include recesses therein which inhibit the spread of the legs and provide a structural connection between the legs of the support when the hopper is mounted thereon. The hopper may be mounted to the legs without the use of tools, but a separate fastener may be used when it is desired to lift both the hopper and its support from above. The support is provided with openings through primary tubular members which align with crossmembers so that forks inserted into the openings pass longitudinally through the crossmembers.

10 Claims, 3 Drawing Sheets

U.S. PATENT DOCUMENTS 4,782,865 A * 11/1988 Everman ..... 141/83
4,836,421 A * 6/1989 Miyoshi et al. ..... 222/166
5,114,040 A * 5/1992 Brenish et al. ..... 222/1
5,154,297 A * 10/1992 Farley ..... 206/599
5,178,292 A * 1/1993 Korzeniowski ..... 220/1.5
5,182,057 A * 1/1993 Johnson ..... 264/31
5,197,601 A * 3/1993 Sterett ..... 206/511
5,249,684 A * 10/1993 Sterett ..... 206/503
5,322,195 A * 6/1994 Ellis ..... 222/105
5,339,996 A * 8/1994 Dubbert et al. ..... 222/185.1
5,490,603 A * 2/1996 Davis ..... 220/4.12
5,520,121 A * 5/1996 Schubart et al. ..... 108/57.1
5,533,456 A * 7/1996 Regina ..... 108/57.29
5,593,067 A * 1/1997 Shaw et al. ..... 222/108
6,247,594 B1 * 6/2001 Garton ..... 206/512
6,328,183 B1 * 12/2001 Coleman ..... 222/185.1
6,772,912 B1 * 8/2004 Schall et al. ..... 222/143
6,923,340 B2 * 8/2005 Ambs ..... 222/105
7,059,575 B2 * 6/2006 Garton ..... 248/346.01
7,140,516 B2 * 11/2006 Bothor et al. ..... 222/185.1
2004/0069808 A1 * 4/2004 Blain ..... 222/185.1
2004/0074922 A1 * 4/2004 Bothor et al. ..... 222/105
2004/0169050 A1 * 9/2004 Ambs ..... 222/105
2004/0182974 A1 * 9/2004 Welland et al. ..... 248/146
2005/0029425 A1 * 2/2005 Garton ..... 248/346.01
2006/0071028 A1 * 4/2006 Ambs ..... 222/185.1
2008/0105676 A1 * 5/2008 Park ..... 220/1.5

OTHER PUBLICATIONS

Ace Roto-Mold Technical Drawing drawn Feb. 28, 2003 for VTIN 28/30-STP (1 page).

Snyder Industries, Inc. sales sheet, Flowmaster Semi-Bulk Storage Silos, Dec. 13, 2004 (1 page).

Snyder Industries, Inc. Open Top Tanks price list, Issued Sep. 23, 2002, (1 page).

* cited by examiner

INDUSTRIAL HOPPER WITH SUPPORT

BACKGROUND OF THE INVENTION

1. Field of the Invention

The present invention is concerned with an industrial bin or hopper which is designed to be rotationally molded and used in combination with a complementally configured stand. Further, the stand is rotationally molded into an economical support which includes efficient use of tubular members to provide a forklift receiver.

2. Description of the Prior Art

Industrial tanks and supports are well known in the art, including those which are rotationally molded. Examples of such prior art tanks and supports include those shown in my U.S. Pat. No. 6,247,594 and Publication No. US-2005-0029425, and in U.S. Pat. No. 5,490,603, the disclosures of which are incorporated herein by reference. These prior art tanks and their supports have a plurality of upright legs with a base extending thereacross so that the bottom of the tank is supported on the base between the legs. Such combinations are useful for holding a variety of industrial liquids and may permit the stacking of combined tanks and supports in a vertical arrangement. The bases may include openings whereby forks of a forklift may be inserted into openings in the base to lift and transport the support and the tank.

However, a different problem is presented when it is necessary to store and dispense solid materials such as powders, granular or pelletized material. Instead of a tank which can have an essentially flat bottom, holding and dispensing such solid materials requires a bin with a fairly aggressive slope (e.g., 45° to 60° from the horizontal) so that the solids will readily flow into a relatively large opening, as contrasted with the relatively small opening through which liquids may flow.

In addition, it has been found that a more secure connection between the support and the bin is desirable. Furthermore, it has been learned that an improved support providing greater stability when carried by a forklift is needed.

SUMMARY OF THE INVENTION

These and other objects are met by the industrial hopper and support of the present invention. That is to say, the present invention provides a significant improvement over the prior art by providing a bin which is complementally configured with the support so that the bin is carried by the legs of the support, rather than on a base extending between the supports. In this manner, not only is an aggressive slope for the sides of the bin permitted, but the weight of the bin and its contents are carried by essentially vertical and upright walls of the bin and the legs of the support. In addition, the support is efficiently configured to provide a stable receiver for the forks of a forklift, with an economy of materials and wherein the support provides for a wide opening area at the bottom of the hopper.

Broadly speaking, the present invention includes a hopper having an upright sidewall in an upper holding zone and a sloping sidewall in a dispensing zone leading to a wide opening for mounting a valve thereon, in combination with a complementally configured support having a plurality of spaced, substantially vertical legs for receiving the hopper thereon and tubular members for structurally connecting the legs. The hopper and the support are manufactured substantially by rotational molding which enables the use of synthetic resin materials which are both economical and resistant to corrosion. The tubular members are arranged so that openings in primary members align with the cavities in at least two crossmembers to receive the forks of a forklift into the openings to provide a lifting surface on the top interior surfaces of the crossmembers. The legs are molded into and extend vertically from at least two of the tubular members so that the legs are held proximate their lower ends.

As noted above, the hopper and its support are complementally configured, and preferably the hopper includes receivers molded into its sidewalls which receive and fit with the top ends of each of the legs. The receivers are most preferably spaced around the sidewall in equidistant arrangement, and located where the upright sidewall transitions to the sloping sidewall. The receivers and top ends of the legs include interfitting recesses and lugs, such that once the lugs are received in the recesses, the legs are prevented from spreading at their top end. By this configuration, the weight of the hopper and its contents is transferred vertically, in compression, to the legs, and the structure of the receivers and the adjacent sidewalls provide structural support to resist transverse spreading of the legs which could otherwise result in slipping of the hopper off of the support. Beneficially, however, the hopper may be readily separated from the support for dumping operations or the like by lifting the hopper by a crane off of the support. The particular configuration of the top surface of the legs and the recesses of the hopper is particularly advantageous because it facilitates the flow of the solid materials within the hopper while at the same time does not require any additional fasteners to maintain the hopper on the support. However, the present invention also advantageously includes coupling structure, for example an ear provided with a hole, whereby a bolt or other fastener may be used so that the support is lifted along with the hopper, when desired. In preferred embodiments, the bin portion of the hopper sidewall may be substantially rectangular in plan, with the corners having an arcuate configuration which aligns with the outboard portion of the upright legs to present a substantially continuous vertical outer surface extending along the legs up and along the sidewall of the hopper at the corners to improve the structural strength of the combination.

The support permits the hopper to be supported directly on the legs, leaving a wide open area at the bottom of the support so that the opening of the hopper, and a valves coupled thereto, may be received in the opening. Thus, instead of a base in the form of planar or other surface extending substantially across the opening, the tubular members surround the open area. The tubular members link the legs together at their bottom end, with preferably four legs being provided. In this arrangement, two of the tubular members are primary members which are preferably centered on the upright legs, and two of the crossmembers extend between the primary members and are integrally formed therewith, and are spaced apart corresponding to the standard distance of the forks of a forklift or pallet-jack. Most preferably, the dimensions of the openings in the primary members are sized somewhat smaller than the cross-sectional internal dimensions of the crossmembers, but having the top margin of the openings aligned with the top interior surface, so that the openings in the primary members act as a visual guide to facilitate entry of the forks into the crossmembers. The top interior surface of each of the crossmembers is preferably flat to thereby permit the normally flat upper surface of the forks to rest thereagainst, thereby minimizing stress concentrations and providing a greater surface area to be supported by the fork.

As a result, a very enconomical, stable and easy-to-use hopper and support is provided. These and other advantages will be readily appreciated by those skilled in the art with reference to the description and drawings which follow.

DESCRIPTION OF THE PREFERRED EMBODIMENT

Figure 1:
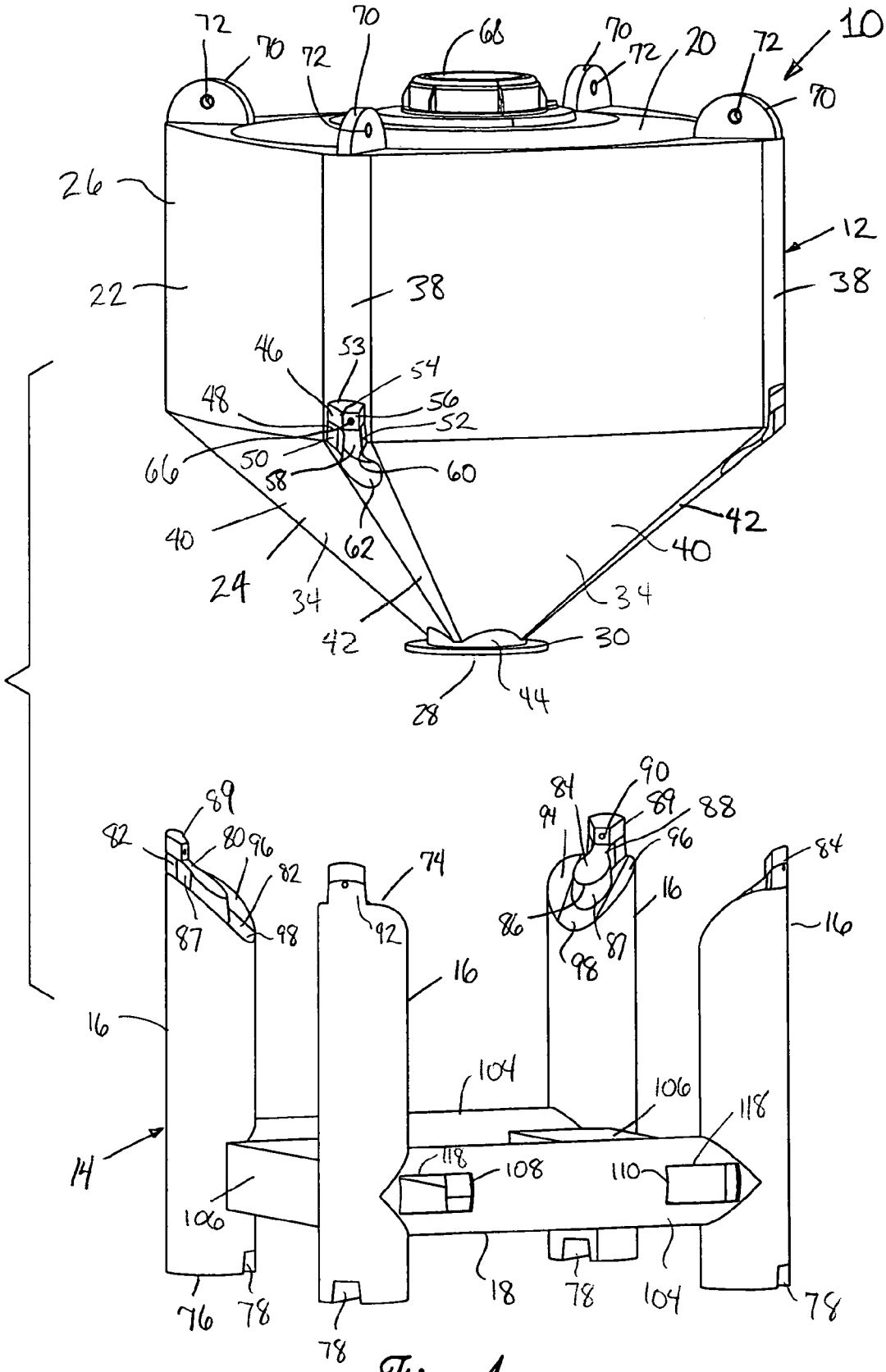
FIG. 1 is an exploded, perspective view of the industrial hopper and support of the present invention, showing the hopper elevated and separated from the support to permit viewing of the complemental connection therebetween.

Referring now to the drawing, an industrial hopper and support system 10 broadly includes a hopper 12 adapted for receiving material therein and discharging material therefrom, and a support 14 positioned beneath said hopper 12 for elevating the hopper 12 above a supporting surface. The hopper 12 hereof is especially configured for receiving and dispensing solids (i.e., particulates, dust, pellets, granular materials, and the like) although it may also be used for retaining and dispensing liquids. The hopper 12 and support 14 are cooperatively configured so that the support 14 may receive and retain the hopper 12 thereon, leaving a wide area for access to receive the hopper 12 discharge. To this end, the support 14 includes a multiplicity of upright support legs 16 and a connector 18 for maintaining the legs 16 in position whereby the hopper 12 may be supported atop the legs 16 and beneficially act structurally to retain the legs 16 against spreading due to the weight of the hopper 12 and its contents.

In greater detail, the hopper 12 preferably includes a top wall 20 and a sidewall 22 defining a dispensing portion 24 and, most preferably, a bin portion 26 above the dispensing portion 24. The bin portion 26 and dispensing portion 24 need not be internally divided and the volume contained therein may be continuous, the terms "bin portion" and "dispensing portion" being used for convenience to indicate that the upper bin portion 24 primarily retains the material while the dispensing portion 24 leads to a discharge opening 28 which may be dimensioned according to the character of the material to be held and discharged therefrom. For example, to avoid binding of the larger pellets, a larger discharge opening may be desired. As may be seen in FIG. 3, the discharge opening 28 is provided with a flange 30 which facilitates mounting of a valve 32 for controlling the dispensing of the contents of the hopper 12. A variety of different valves 32 may thus be attached depending on the material held within the hopper, for example butterfly valves, sanitary butterfly valves, iris valves, slide gate valves, or a variety of other valves for controlling the dispensing of liquid or solids.

The sidewall 22 may be of a variety of different configurations, such that the portion of the sidewall 22 defining the bin portion 26 may be cylindrical or other shapes, and the portion of the sidewall 22 defining the dispensing portion 24 has a sloping sidewall 34 which may be configured as an inverted frustoconical shape. More preferably, the portion of the sidewall 22 defining the bin portion 26 is generally polygonal in plan, such as a substantially rectangular shape, having four panels 36 connected by arcuate corners 38 when viewed in plan. The panels 36 are generally flat or slightly arcuate. The arcuate corners 38 help to avoid stress concentrations and most preferably have a radius of at least 2 inches and more preferably about 4 inches. The sloping sidewall 34 portion of the sidewall 22 defining the dispensing portion 24 is preferably in the shape of an inverted tetrahedron including four downwardly and inwardly sloping triangular walls 40 connected by downwardly tapering connecting ridges 42 which are generally aligned in a radially oriented plane with the arcuate corners 38. As used herein, the term "radial" is intended to mean a direction extending between the center of the hopper or the support and outwardly therefrom when viewed in plan, notwithstanding that the hopper or the support is not circular when viewed in plan. The triangular walls 40 and the ridges 42 lead downwardly and inwardly from the portion of the sidewall 22 defining the bin portion 26 to a collar 44 surrounding and defining the discharge opening 28.

Figure 2:
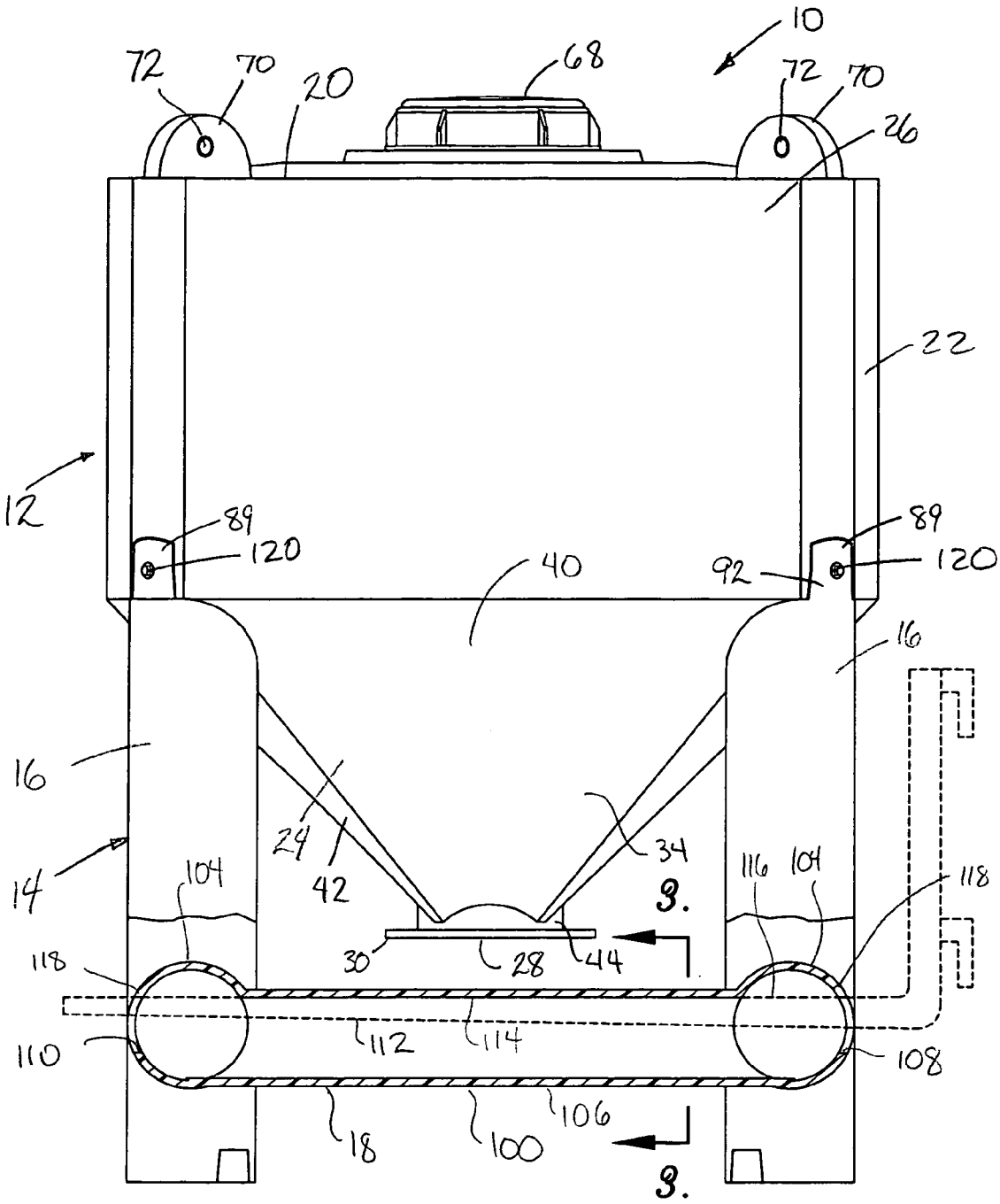
FIG. 2 is an enlarged side elevational view in partial section of the industrial hopper mounted and secured to the support by fasteners, with portions of the support shown in section and a fork of a forklift shown in phantom.
Figure 4:
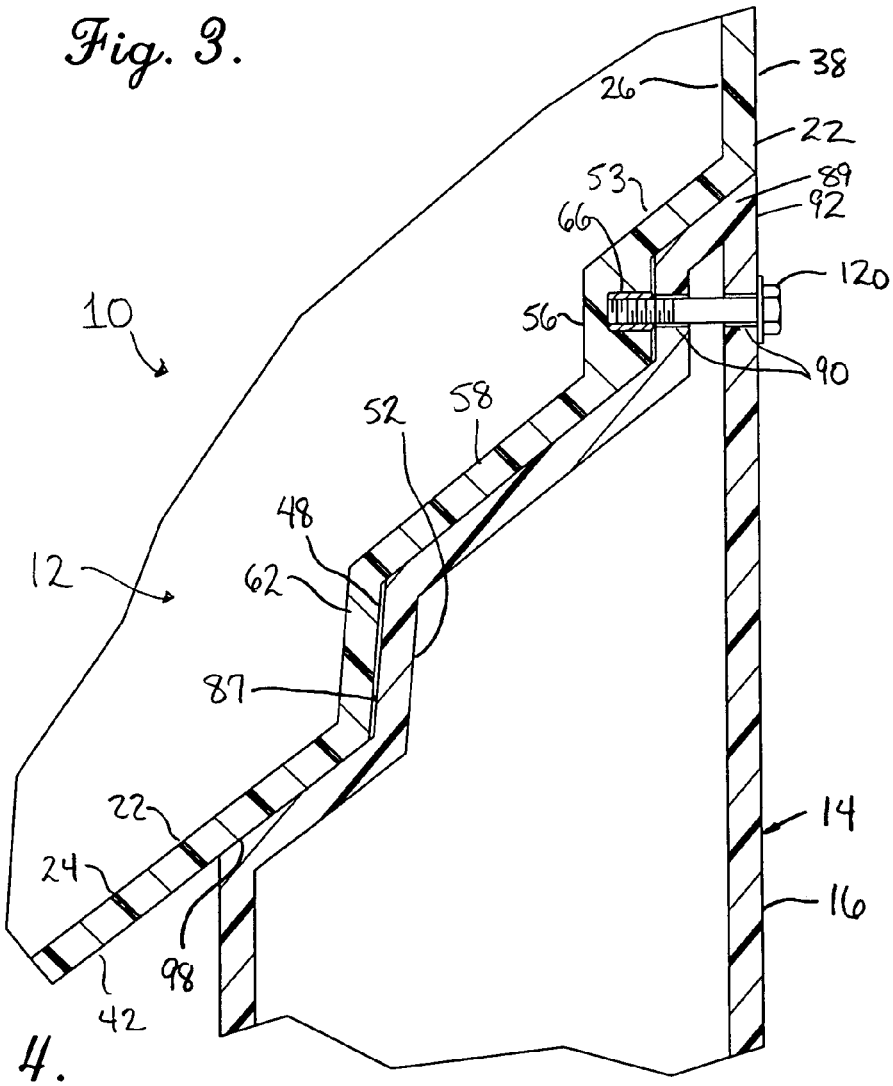
FIG. 4 is an enlarged, fragmentary cross-sectional view of the top end of one of the legs inserted into the complementally configured receiver at a corner of the hopper to show the internal slope within the dispensing zone of the hopper and the alignment of the outboard surface of the hopper sidewall in the bin zone with the leg of the support aligned therewith.

At least one, and preferably a plurality of receivers 46 are formed in the sidewall 22 at spaced locations therearound to receive portions of the upright legs 16 therein. The receivers 46 are preferably evenly spaced around the sidewall 22 and include a recess 48 extending inwardly into the hopper 12. The receivers 46 are most preferably positioned as shown in FIGS. 2 and 4, extending upwardly from the sloping sidewall of the dispensing portion 24 at the ridges 42 where the ridges 42 connect with the arcuate corners 38 and thus preferably at a location near or at the junction of the bin portion 26 and the dispensing portion 24. The recesses 48 each comprise a plurality of surfaces which extend downwardly as shown in FIG. 4 to facilitate the flow of material from the hopper 12 through the discharge opening 28. These surfaces include opposing side surfaces 50 and 52 with a saddle 53 extending therebetween to present a relatively wide notch 54 between the opposing side surfaces, a riser 56 extending generally downwardly from the notch 54, a shelf 58 which is downwardly sloping and extends inwardly from the riser 56. The spacing between the side surfaces 50 and 52 narrows along a portion of the shelf 58 to present a waist 60 which is relatively narrow compared to the notch 56. Inboard and downwardly from the waist 60, the distance between the side surfaces 50 and 52 increases such that the shelf 58 widens and then converge at an inboard tip 62 so that the shelf 58 assumes the shape of a shoe sole. The inboard tip 62 extends downwardly to join with the respective ridge 42. The riser 56 preferably has a hole 64 extending partway, but preferably not fully through the riser, to receive an internally threaded receptacle 66. The receptacle 66 is most preferably flat sided, such as hex shape, to resist turning in the hole, 64, and made of brass or other material relatively resistant to corrosion.

The top wall 20 preferably includes a fill opening centrally positioned thereon, and which has a threaded fillneck to receive a removably mounted closure cap 68 thereon. A plurality of lifting lugs 70 having holes 72 for receiving lifting hooks, cables, slings or forklift bracket attachments therethrough for lifting of the hopper 12, and are spaced around the top wall 20 proximate the side wall 22. The lifting lugs 70 are preferably fabricated of steel, and most preferably stainless steel, and are molded into the top wall 20 during rotational molding of the hopper of preferably translucent polyethylene or other suitable synthetic resin material.

The support 14 is also rotationally molded of polyethylene or other suitable synthetic resin material whereby the upright support legs 16 and the connector 18 is formed as an integrally formed, unitary member. The legs 16 extend above and below their connection to the connector 18 whereby the connector 18 is preferably elevated above a supporting surface. A multiplicity of legs 16 are provided in spaced relationship to one another, each including a top end 74 and a bottom end 76. The bottom end 76 is configured for resting on a supporting surface and includes a radially oriented slot 78 therein. The legs 16 are tubular and hollow, and preferably circular in cross section. The top end 74 of each leg 16 is sloped downwardly and radially inwardly, and includes a lug 80 and a cradle 82. The lug 80 is formed in the shape of an inverted shoe, having a radially outward heel portion 83, a sole portion 84 which is rounded and expands outwardly, then narrows to a toe 86, with the lug 80 having a margin 87 which extends upwardly from the cradle 82. A shank portion 88 is positioned between the heel 83 and the sole 84, and relatively narrower than both the widest part of the heel 83 and the widest part of the sole 84. The heel 82 includes an upwardly projecting ear 89 which includes a radially extending channel 90 therethrough. The radially outboard exterior surface 92 of the lug 80 is rounded and arcuate with a radius which substantially conforms to the arcuate corner 38. The cradle 82 is positioned on each side and inwardly of the lug 80 and slopes radially inwardly and downwardly, thereby being configured for receiving the sloping sidewall 34 and particularly the ridges 42 and walls 40 of the dispensing portion 24 of the hopper 12 thereon. The cradle 82 includes first shoulder surface 94 and second shoulder surface 96, the shoulder surfaces 94 and 96 being generally convergent toward one another across a radially extending line therebetween. The shoulder surfaces 94 and 96 are complementally configured to the shape of adjacent walls 40 of the hopper 12 so as to support the hopper thereon. Thus, the first and second shoulder surfaces 94 and 96 are generally inclined downwardly in a radial direction from outboard to inboard and also convergent in that they are inclined toward one another across and inclined toward a radially extending line passing therebetween. The cradle 82 also includes an arcuate seat 98 positioned between the shoulders 94 and 96 which slopes downwardly and inwardly, the seat 98 having the arcuate configuration to mate with and receive the ridge 42 of the hopper 12 thereon.

Figure 3:
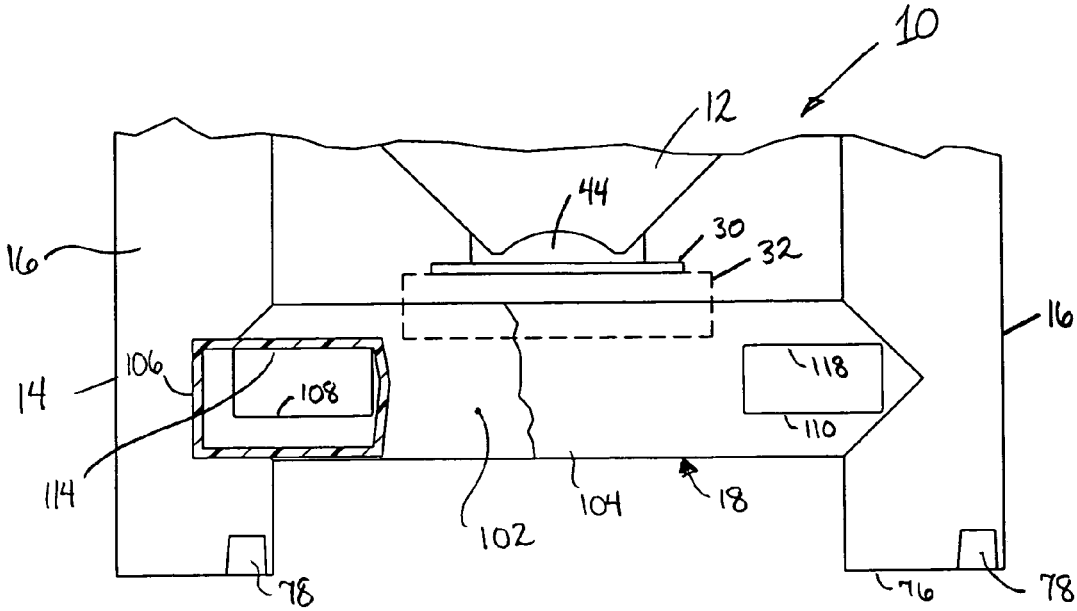
FIG. 3 is a fragmentary front elevational view in partial section showing a valve in phantom and the relative alignment of the openings in the primary supports with the internal surface of the crossmembers.

The connector 18 is generally horizontally oriented and includes a multiplicity of tubular members 100 which connect respective legs and present a large open area 102 therebetween for receiving the valve 32 of the hopper 12 as shown in FIG. 3. The tubular members 100 preferably include a pair of elongated, spaced-apart, tubular primary members 104 oriented parallel to one another, and a pair of elongated, spaced-apart tubular crossmembers 106 oriented parallel to one another and perpendicular to the primary members 104. The primary members 104 each include openings 108 and 110 therein which are spaced apart at a distance to receive the forks 112 of a forklift or pallet jack therein, e.g. about 19 inches apart. The fork entry openings 108 and 110 are of a sufficient size to facilitate entry by the forks, without being too great so as to permit substantial shifting or weakening of the primary members. Thus, a preferred size of the fork openings 108 and 110 is about 3.5 inches high by 7 inches wide. The fork entry openings 108 and 110 are aligned with the crossmembers 106 so that a fork 112 enters through a respective one of the openings 108 and 110 and is received within one of the crossmembers 106, and may pass out through one of the fork entry openings in the opposite primary member 104, as shown in FIG. 2. As may be seen in FIGS. 1 and 2, the crossmembers 106 may have a variety of different cross sectional configurations but most preferably have a relatively flat top interior surface 114 which is positioned along the uppermost portion of the crossmembers so as to receive thereagainst a part of the corresponding flat upper edge 116 of the fork 112. Similarly, the openings 108 and 110 are aligned so that their top margin 118 is substantially coplanar with the flat top interior surface 114 of the crossmember, as shown in FIG. 3. The primary members 104 are connected to the upright legs 16 so as to be substantially centered thereon and provide good support, but contrary to what would be expected, the crossmembers 106 are not similarly centered on the upright legs 16, but rather only about half of each crossmember 106 is in contact with the two upright legs 16, the other approximately half of the crossmember 106 being in contact with the two primary members 104. This also permits the fork entry openings 108 and 110 to be substantially centered on a vertical line running along a tangent to the outside of a respective leg 16, as seen in FIG. 3, to thereby provide additional structural support both in a dispensing mode and when lifted by a forklift or pallet jack.

As noted above, the hopper 12 and the support 14 are separately formed by rotational molding of polyethylene with the lifting lugs 70 included in the mold during molding. The selected valve 32 is attached and the hopper 12 lowered onto the support 16 whereby the system 10 is ready for use. The hopper 12 is lowered onto the support 16 whereby the top ends 74 of each leg are received within a complementally configured receiver 46 which includes the lug 80 being received into recess 48 formed in the sidewall 22. Advantageously, the ear 84 fits into notch 54, the shank 88 fits into the waist 60 between the side surfaces 50 and 52 and the sole 84 is received on the shelf 58 between the side surfaces 50 and 52. The weight of the hopper 12 and its material contents is also borne by the cradle 82 in addition to the lug 80, the configuration of the lug and cradle also resisting movement of the leg in a direction transverse to the radial. Movement of the hopper 12 inwardly relative to the top ends 74 (and also outward spreading of the top ends 74) is resisted both by the tubular members of the connector 18 but also by the complemental configuration of the top ends 74 and the receivers 46. The relatively narrow waist portion 60 engages both the sole 84 and the heel 82 to resist radial movement of the top end of the legs 16 relative to the hopper 12. The hopper 12 thus provides structural support and stability to maintain the legs 16 in an upright orientation to maximize their load-supporting capability. Moreover, the outboard outer surface of the legs 16 is substantially vertically aligned with the bin portion 26 of the sidewall 22, and especially the arcuate corners 38, to further enhance structural integrity both vertically and horizontally as a result of the interlocking relationship of the lug 80 with the recess of the receiver in each leg 16. This is accomplished without the need for additional mechanical fasteners, although bolts 120 or other mechanical fasteners may be used to prevent vertical separation of the hopper 12 from the support 14 during, for example, lifting of the entire system 10 by a crane by attachment to the lifting lugs. Because the receivers are continuously inclined toward the discharge opening, the flow of the material contents of the hopper 12 are not trapped or retained in the receivers. The cradle 82 at the sides and inwardly of the lug 80 is also inclined, and presents a wider load distribution surface for receiving the discharge portion 24 of the hopper thereon. The ears of the lug 80 also are configured to mate with and conform to the outer surface of the sidewall 22 to not only receive a fastener but to provide vertical vertical alignment with the sidewall 22. In addition, the wide open area provided in the support between the tubular members readily accommodates the large discharge opening 28 and the valve 32 at the lower end of the hopper 12. The support 14 is advantageously configured to economize material while providing an excellent design for receiving a forklift for transport of the system 10.

As a result, a substantial improvement in industrial hopper and support systems is provided by the present invention.

Although preferred forms of the invention have been described above, it is to be recognized that such disclosure is by way of illustration only, and should not be utilized in a limiting sense in interpreting the scope of the present invention. Obvious modifications to the exemplary embodiments, as hereinabove set forth, could be readily made by those skilled in the art without departing from the spirit of the present invention.

The inventor hereby states his intent to rely on the Doctrine of Equivalents to determine and assess the reasonably fair scope of his invention as pertains to any apparatus not materially departing from but outside the literal scope of the invention as set out in the following claims.

The invention claimed is:

1. In combination:

a hopper having a sidewall including a sloping portion and a lower opening for discharging material contained within the sidewall, said sidewall including at least one receiver therein; and a support positioned beneath said hopper for supporting the hopper above a supporting surface, said support including a plurality of upright legs and a connector extending transversely between said upright legs to connect adjacent legs, each of said legs including a bottom end and a top end, the top ends of at least one of the legs having a portion configured for receipt in a corresponding receiver of said hopper whereby said hopper is supported on the top ends of the upright legs in spaced relationship to said connector, wherein said top ends of the upright support legs include an upwardly projecting lug with a relatively narrow shank portion and a relatively wider sole portion located inboard relative to said shank portion and the receiver includes a recess complementally configured to the lug.

2. The combination of claim 1, wherein the top ends of the upright legs include a sloping portion for supporting a portion of said sloping sidewall thereon.

3. The combination of claim 1, wherein the lug includes a relatively wide heel portion and recess includes a relatively narrow waist portion located inboard of said heel portion when said lug is inserted into said recess, said waist portion fitting complementally around said shank portion and said heel portion having a width greater than the width of the waist portion of said recess.

4. The combination of claim 3, wherein the lug includes an upwardly projecting ear having a channel therethrough, and the sidewall has a threaded receptacle aligned with the hole, and including a threaded fastener inserted through said channel and into said receptacle for attaching the support to the hopper.

5. The combination of claim 4, wherein the sidewall includes a notch complementally configured for receiving said ear, said leg having a radially outer surface which is in substantial vertical alignment with the sidewall positioned over the outer surface.

6. The combination of claim 1, wherein said connector includes tubular members comprising a first pair of generally parallel primary members and a second pair of generally parallel crossmembers in spaced relationship to one another and interconnecting said primary members.

7. The combination of claim 6, wherein said tubular members are positioned more proximate the bottom ends than the top ends, and wherein each of the primary members includes at least a pair of openings therein sized for receiving a fork of a forklift, wherein said pair of openings of each of said primary members are aligned with and connected by a passage extending through one of said crossmembers.

8. The combination of claim 1, wherein said hopper and said support are molded of synthetic resin material.

9. A hopper adapted for receiving and discharging material comprising:

a sidewall defining a holding zone having an upright sidewall and a dispensing zone having a sloping sidewall extending generally downwardly and inwardly from the upright sidewall; and a lowermost opening for dispensing material therefrom, wherein said sidewall includes a plurality of receivers in spaced relationship around the surface of the sidewall and located along said sloping sidewall proximate said upright sidewall, said receivers including a heel portion and a waist portion inboard of the heel portion having a width between opposing waist-defining surfaces in said receiver which is relatively narrower than a widest transverse dimension of the heel portion.

10. In combination:

a hopper having a sidewall including a sloping portion and a lower opening for discharging material contained within the sidewall, said sidewall including at least one receiver therein; and a support positioned beneath said hopper for supporting the hopper above a supporting surface, said support including a plurality of upright legs and a connector extending transversely between said upright legs to connect adjacent legs, each of said legs including a bottom end and a top end, the top ends of at least one of the legs having a portion configured for receipt in a corresponding receiver of said hopper whereby said hopper is supported on the top ends of the upright legs in spaced relationship to said connector, wherein said top ends of the upright support legs include an upwardly projecting lug and a cradle configured for receiving a portion of said sloped portion thereon, and the receiver includes a recess complementally configured to the lug, and said sloped portion presents a generally inverted tetrahedron shape when received on said support, and said cradle includes first and second generally convergent shoulder surfaces, both of said first and second shoulder surfaces being generally inclined radially downwardly in an outboard to inboard direction and each of said first and second shoulder surfaces being generally oppositely inclined downwardly toward a radially extending line extending therebetween, and said cradle further including a generally arcuate radially oriented seat positioned between said shoulder surfaces.

* * * * *